United States Patent [19]

Itoda et al.

[11] 3,950,921

[45] Apr. 20, 1976

[54] COIN PACKAGING APPARATUS WITH SELF-ADJUSTMENT TO WRAPPER PAPER WIDTH

[75] Inventors: Masaru Itoda; Shiro Nakai; Masatoshi Ushio; Hirokuni Matono; Takao Baba, all of Himeji, Japan

[73] Assignee: Glory Kogyo Kabushiki Kaisha, Himeji, Japan

[22] Filed: July 8, 1975

[21] Appl. No.: 594,078

[30] Foreign Application Priority Data

July 19, 1974 Japan ..... 49-82246
Jan. 31, 1975 Japan ..... 50-13105

[52] U.S. Cl. ..... 53/67; 53/201; 53/212; 83/368

[51] Int. Cl.[2] ..... B65B 11/04

[58] Field of Search ..... 53/67, 201, 211, 212; 93/61 AC; 83/368

[56] References Cited

UNITED STATES PATENTS

| | | | |
|---|---|---|---|
| 2,709,880 | 6/1955 | Jorgensen | 53/212 X |
| 3,085,376 | 4/1963 | Ferguson, Jr. et al. | 53/75 |
| 3,260,142 | 7/1966 | Nitchie et al. | 83/368 X |
| 3,821,917 | 7/1974 | Hatanaka | 53/212 X |
| 3,905,176 | 9/1975 | Ushio | 53/212 |

*Primary Examiner*—Travis S. McGehee
*Assistant Examiner*—John Sipos
*Attorney, Agent, or Firm*—Wenderoth, Lind & Ponack

[57] ABSTRACT

In a coin packaging apparatus of the type comprising a stacking cylinder for stacking a prescribed number of coins of the same denomination, a cutter blade for severing a wrapper strip as the same is unwound from its roll, wrapping rolls for winding the severed piece of wrapper strip around the circumference of the stack of coins, and a pair of crimping hooks for crimping the opposite marginal edges of the wrapper strip over both ends of the coin stack, several wrapper rolls of different widths are used interchangeably in accordance with the denomination of coins to be packaged, and each time a new wrapper roll is installed in position on the apparatus, its width is sensed by a wrapper width sensing member which correspondingly actuates a mechanism for adjustably moving one of the crimping hooks in the direction of the other hook and a mechanism for adjustably changing the position of the cutter blade in the transverse direction of the wrapper strip which will extend therepast from its roll.

8 Claims, 6 Drawing Figures

COIN PACKAGING APPARATUS WITH SELF-ADJUSTMENT TO WRAPPER PAPER WIDTH

BACKGROUND OF THE INVENTION

This invention relates to apparatus for packaging each prescribed number of coins of the same denomination in a neat stack, and in particular to improvements in coin packaging apparatus of the type disclosed in U.S. Pat. Application Ser. No. 474,150 filed May 28, 1974, by M. Ushio et al and assigned to the instant assignee. Even more particularly, the invention deals with means for automatic adjustment of some operating parts or components of the coin packaging apparatus in accordance with the width of a roll of wrapper strip in use.

The coin packaging apparatus of the type under consideration is designed to handle several denominations of coins. Each time coins of a different denomination are to be packaged by the apparatus, therefore, the wrapping and various other mechanisms of the apparatus must be readjusted to suit the diameter or thickness of the coins. Manual readjustment of all such parts or components is highly troublesome and time-consuming, giving rise to the possibility that the coins may not be packaged properly through failure of readjustment of any of the parts.

One of the mechanisms of the coin packaging apparatus that need readjustment involves a pair of crimping hooks which, after a piece of wrapper strip has been wound around the circumference of a stack of coins, will fold or crimp the lateral marginal edges of the wrapper strip over the opposite ends of the coin stack. Since several wrapper rolls of different widths are used interchangeably in accordance with the denomination or thickness of coins to be packaged, the spacing between the crimping hooks must be adjusted to the width of each new wrapper roll in use.

Another part in need of readjustment is a cutter blade designed to cut the wrapper strip to a suitable length as the same is unwound under tension from its roll. The cutter blade usually has a sawtooth cutting edge of generally V-shaped configuration with a projecting apex. The apex of this cutting edge first pierces the wrapper strip extending therepast under tension, and the wrapper strip is then torn apart along the sloping edges on both sides of the apex.

It will therefore be apparent that regardless of the width of the wrapper strip in use, the apex of the V-shaped cutting edge should be located centrally in the transverse direction of the wrapper strip extending therepast along a predetermined path. Otherwise, the wrapper strip would not be severed smoothly, and if severed at all, would have its ends shaped asymmetrically. A package of coins formed by use of such a piece of wrapper strip is unsatisfactory in appearance because one of the asymmetrically shaped ends of the wrapper strip visibly appears on the outside.

SUMMARY OF THE INVENTION

It is an object of this invention to provide an improved coin packaging apparatus including means for automatic or self-adjustment of the spacing between a pair of crimping hooks to the width of each new wrapper roll in use.

Another object of the invention is to provide a coin packaging apparatus which also includes means for automatically adjusting the position of a cutter blade in accordance with the width of the wrapper roll in use so that the apex of its V-shaped cutting edge may be located centrally in the transverse direction of the wrapper strip which will extend therepast from the roll.

A further object of the invention is to provide a coin packaging apparatus wherein the width of each new wrapper roll installed in position thereon is sensed by mechanical means which is capable of correspondingly actuating the above mentioned adjusting means and which is well calculated to permit the operator to use both hands to hold a wrapper roll during replacement from one wrapper roll to another.

A further object of the invention is to provide a coin packaging apparatus wherein the wrapper width sensing means is associated with an electric switch in a manner such that the operation of the apparatus cannot possibly be initiated inadvertently unless the necessary readjustment has been completed following the installation of a new wrapper roll.

With these and other objects in view the invention is directed, in brief, to a coin packaging apparatus of the type comprising stacking means for arranging each preselected number of coins of the same denomination into a neat stack, cutter means for severing a wrapper strip as the same is unwound from its roll, coin wrapping means for winding the severed piece of wrapper strip around the circumference of the stack of coins, and a pair of crimping hooks for cimping the opposite marginal edges of the piece of wrapper strip over both ends of the stack of coins. The coin packaging apparatus of this type is disclosed in detail in the noted U.S. Pat. Application Ser. No. 474,150.

Characteristically, the invention includes means for holding a roll of wrapper strip so that one of the opposite marginal or lateral edges of the wrapper roll will always lie in a predetermined position thereon regardless of its width. The wrapper roll on the holding means has a width suitably in excess of the height of the stack of coins to be wrapped succeedingly. Wrapper width sensing means is provided which includes a wrapper width sensing member movable in the transverse direction of the wrapper roll on the holding means into and out of contact with the other marginal edge thereof. The motion of this wrapper width sensing member into contact with the wrapper roll on the holding means causes hook-adjusting means to adjustably move one of the crimping hooks in the direction of the other crimping hook, so that the spacing between the crimping hooks is adjusted to the width of the new wrapper roll on the holding means.

According to another aspect of the invention the motion of the wrapper width sensing member into contact with the wrapper roll also causes the cutter blade to adjustably move in the transverse direction of the wrapper strip which will extend therepast from the roll so that the apex of its V-shaped cutting edge will be located contrally with respect to the wrapper strip, i.e., equidistant from its lateral edges. Thus, upon movement of the wrapper width sensing member into contact with the wrapper roll on the holding means, the spacing between the crimping hooks and the position of the cutter blade are simultaneously adjusted to the width of the wrapper roll.

The features which are believed to be novel and characteristic of this invention are set forth in particular in the appended claims. The invention itself, however, both as to its organization and mode of operation, together with the further objects and advantages thereof, will become apparent from the following description which is to be read in connection with the accompanying drawings in which like reference characters refer to like parts throughout.

DETAILED DESCRIPTION

Figure 1:
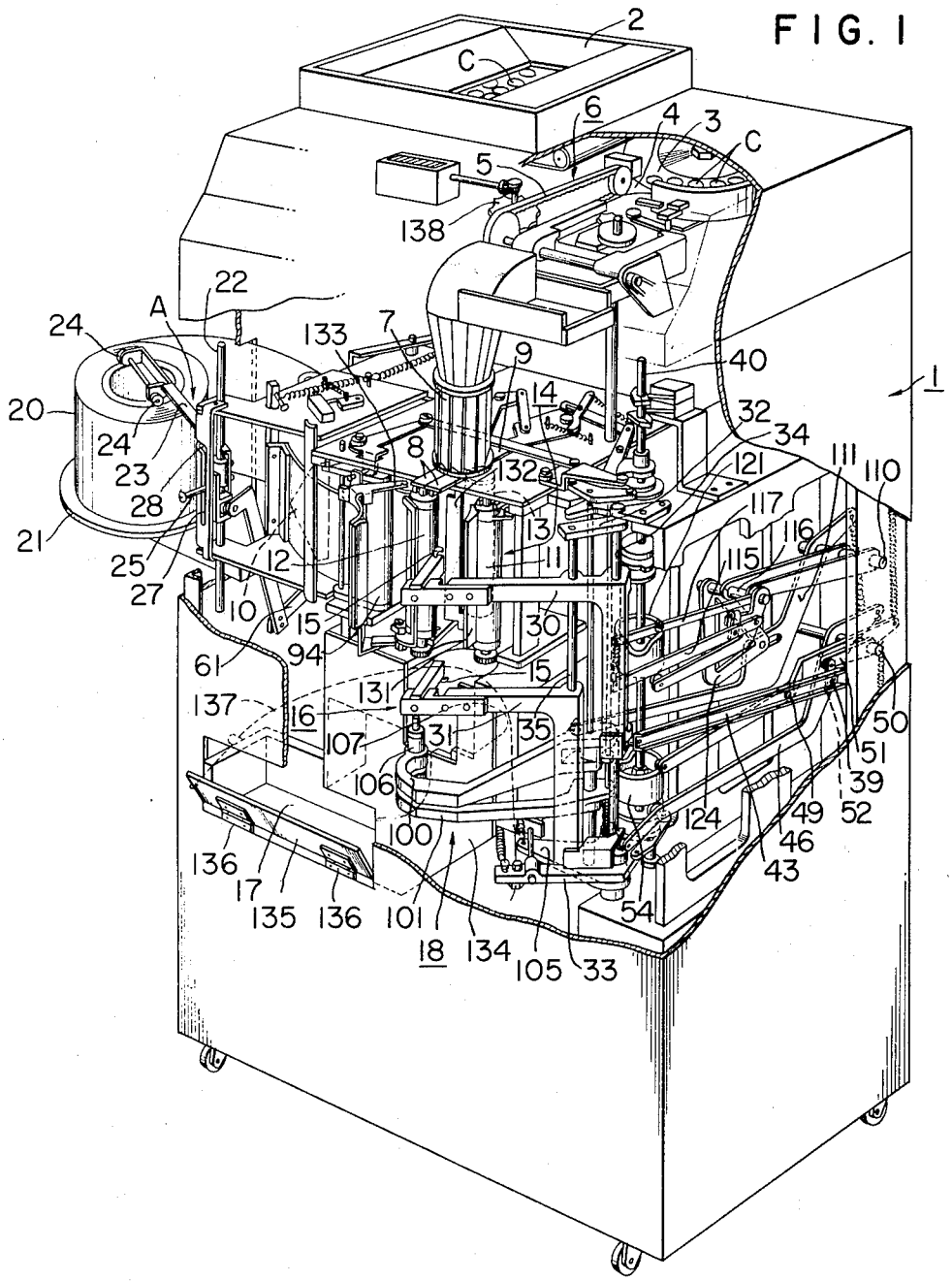
FIG. 1 is a perspective view of the coin packaging apparatus incorporating the novel concepts of this invention, in which the casing of the apparatus is shown partly broken away to illustrate the inside details.

As conducive to a full appreciation of the features and advantages of this invention, the general organization of the coin packing apparatus to which the invention is directed will first be briefly described. With reference therefore to FIG. 1, the coin packaging apparatus generally designated by the reference numeral 1 includes a hopper 2 formed on the top of the substantially rectangular casing. A batch of coins C of the same denomination that has been charged into this hopper is delivered onto a rotary disc 3, from which the coins are centrifugally sent out one by one via a guide 4 onto a linear passageway extending radially outwardly from the disc. An overhead belt conveyor 5 extends along this passageway to frictionally transport the successive coins to its exit end. Arranged adjacent the exit end of the coin passageway is a counter mechanism 138 which is effective in temporarily closing the passageway each time it counts a preselected number of coins traveling therepast. The reference numeral 6 generally represents an infeed mechanism constituted by the above described parts and components.

A stacking cylinder 7 comprising a plurality of overlapping plate members is arranged under the exit end of the coin passageway for rearranging each preselected number of coins into a neat stack as they are delivered from the infeed mechanism 6. The bottom end of the stacking cylinder 7 is openably closed by a shutter mechanism 9 including a pair of coplanar plate members 8. These plate members are movable simultaneously toward and away from each other, holding the bottom end of the stacking cylinder 7 closed while the coins are being stacked up therein and opening the same upon completion of each stacking operation.

Arranged under the stacking cylinder 7 is a coin wrapping mechanism 14 comprising at least three wrapping rolls 11, 12 and 13 adapted to receive the stack of coins centrally therebetween as the stack is guided down from the stacking cylinder. The three wrapping rolls 11 to 13 will then move into circumferential contact with the stack of coins and frictionally impart rotation thereto, thereby winding around the stack a strip of wrapper which has been unwound from its roll 20 and cut to a predetermined length by a cutter blade 10.

The coin wrapping mechanism 14 is closely associated with a wrapper crimping mechanism 16. The wrapper crimping mechanism 16 includes a pair of crimping hooks 15 such that the lateral edges of the wrapper strip which has been wound around the stack of coins are fold-crimped over the top and bottom ends of the coin stack.

A coin support mechanism 18 supports the bottom end of the coin stack as the same is wrapped up by the wrapping and crimping mechanisms 14 and 16. Upon completion of the wrapping operation the support mechanism 18 will retract to deliver the packaged stack of coins to a dispensing opening 17.

All the enumerated constituent mechanisms of the coin packing apparatus can be driven in timed relationship by means comprising cams, gears and so forth. In the illustrated coin packaging apparatus, several wrapper strips of different widths are to be used selectively in accordance with the denomination or thickness of coins to be packaged. The selected wrapper strip is wound around the stack of coins so that its marginal edge portion projecting beyond the bottom end of the stack will be constant in width regardless of the denomination of the coins, or regardless of the total width of the wrapper strip. The opposite marginal edge portion of the wrapper strip projecting beyond the top end of the stack, however, is made approximately equal in width to the downwardly projecting edge portion through appropriate selection of the wrapper strip width.

Figure 2:
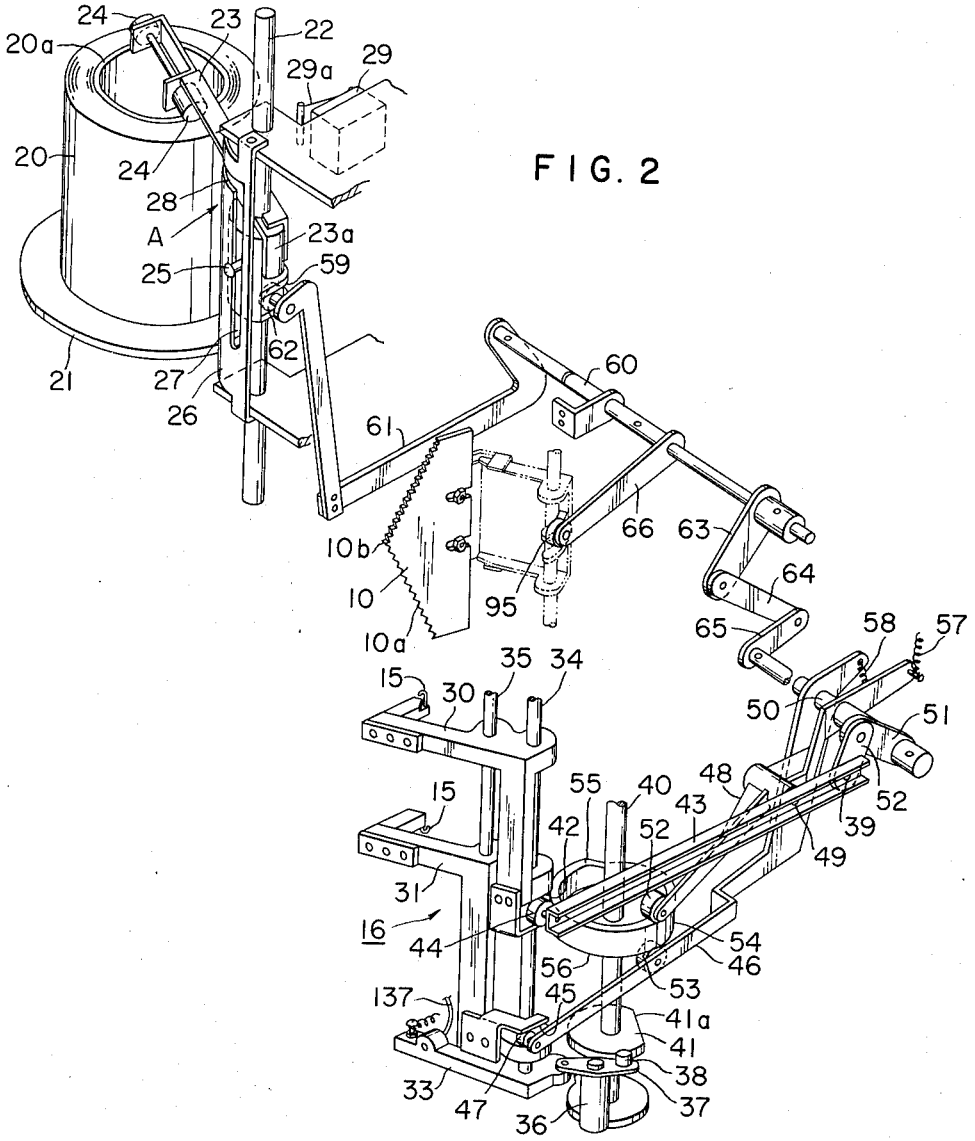
FIG. 2 is a relatively enlarged perspective view showing in greater detail the means for sensing the width of each new wrapper roll in use and the means for correspondingly adjusting the spacing between the pair of crimping hooks in the apparatus of FIG. 1.

Shown at A in FIGS. 1 and 2 is a mechanism for sensing the width of each new wrapper strip in use. A roll 20 of the wrapper strip is rotatably supported on a mount 21 so as to permit the wrapper strip to be unrolled therefrom as required. A column 22 is fixedly arranged adjacent the mount 21, and a wrapper width sensing member 23 has its ends **23*a* slidably mounted on the column 22 so as to be swingable horizontally and movable up and down relative to the column. Extending over the mount 21, the wrapper width sensing member 23 carries a pair of rollers 24 that are normally arranged for abutting contact with a hollow core 20*a* of the wrapper roll 20** at its diametrically opposite points.

The wrapper width sensing member 23 has a pin 25 on its end **23*a*, and this pin is slidably received in an inverted-L-shaped slot 27 that is formed in a guide 26 fixedly supported parallel to the column 22. Thus, as long as the pin 25 is received in the vertical limb of the slot 27, the wrapper width sensing member 23 is retained in the diametrical direction of the wrapper roll 20 even if the wrapper roll rotates as the wrapper strip is unrolled therefrom. The wrapper width sensing member 23 is raised and held out of contact with the wrapper roll 20 when the pin 25 enters the horizontal limb 28 at the top end of the slot 27. The wrapper width sensing member 23 is then swingable horizontally out of vertical register with the wrapper roll 20**.

An electric switch 29 with its actuator **29*a* is so arranged as to be actuated by the wrapper width sensing member 23 upon its swinging motion out of vertical register with the wrapper roll 20. The electric circuitry, not shown, of the coin packing apparatus 1 can be arranged, in a manner apparent to the specialists, so that the apparatus cannot possibly be set in operation as long as the switch 29 is held actuated. The switch 29** is therefore effective in sensing the fact that the adjustment has been completed with respect to the wrapper roll of the correct width for use with the desired denomination of coins to be packaged.

The wrapper crimping mechanism 16, which operates as aforesaid in conjunction with the coin wrapping mechanism 14, includes a pair of L-shaped arms 30 and 31 extending horizontally in parallel speced apart relationship. These arms carry at their tips the respective crimping hooks 15 which are each substantially U-shaped. The arms 30 and 31 are floatingly supported in vertical register by a pair of parallel spaced apart shafts or rods 34 and 35 extending vertically between support plates 32 (FIG. 1) and 33. These support plates are pivotable about the rod 34.

A lever 37 swingable about a shaft 36 is pivotally connected at one of its ends to the lower support plate 33. The lever 37 carries a roller cam follower 38 on the other end that is biased by spring means, not shown, into contact with a cam 41 mounted on a driving camshaft 40. The cam 41 has a depression 41*a* on its circumference such that when the cam follower 38 is located on the depression, the lever 37 causes the support plate 33 to swing clockwise as seen in FIG. 2. The pair of crimping hooks 15 thereupon advance to their operating position between the wrapping rolls 11 to 13 for engaging the top and bottom marginal edges of the wrapper strip wound around the stack of coins.

The arm 30 for the upper cimping hook 15 has a recess at 42 for receiving a roll 44 on one end of a lever 43 designed to cause the up-and-down motion of the upper arm 30. The lower arm 31 also has a recess at 45 for receiving a roll 47 on one end of a lever 46 designed to cause the up-and-down motion of the lower arm. These levers 43 and 46 are swingable to cause the upper and lower arms 30 and 31 to move toward and away from each other along the rods 34 and 35, as will more fully appear hereinbelow.

The lever 43 for the up-and-down motion of the upper arm 30 is pivotally pinned at its intermediate point 49 to a lever 48, and the other end of this lever 43 is pivotally pinned at 39 to a link 52 which in turn is likewise pinned to a lever 51 fixedly mounted on a shaft 50. The levers 46 and 48 have their basal ends pivotally or loosely mounted on the shaft 50.

The lever 48 carries on its free end a roller cam follower 52, while the lever 46 for the up-and-down motion of the lower arm 31 carries another roller cam follower 53 at its intermediate points. These cam followers 52 and 53 are urged by respective helical tension springs 57 and 58 into contact with the top and bottom circumferential edges of a cam 54 on the camshaft 40.

The aforesaid wrapper width sensing member 23 is operatively associated with the wrapper crimping mechanism 16 via the following means described with reference to FIG. 2. The end 23*a* of the member 23 has a recess 59 for receiving a roll 62 on one end of an L-shaped link 61, the other end of which is fixedly coupled to a horizontal, rotatable shaft 60. This shaft has a lever 63 fixedly mounted thereon, which lever is coupled via a link 64 to a lever 65 fixedly mounted on the shaft 50. The link 64 is pivotable relative to the levers 63 and 65, in such a manner that the rotation of the shaft 60 is conveyed to the shaft 50 with its rotation reversed.

Thus, in accordance with the angle of swing of the link 61 about the shaft 60, the lever 43 for the up-and-down motion of the upper arm 30 is caused to swing correspondingly about the pivot pin 49. The angle of swing of the lever 43 is such that the roll 44 on its free end moves up or down a distance equal to the increase or decrease in the width of the wrapper roll 20 on the mount 21 from a predetermined reference value.

The cutter blade 10 is supported uprightly and has a V-shaped cutting edge 10*a* formed on one side. The position of this cutter blade is adjustably variable in the vertical direction, that is, in the transverse direction of the wrapper strip extending therepast, in accordance with the width of the wrapper strip in use, as hereinafter explained with reference to FIG. 3.

Figure 3:
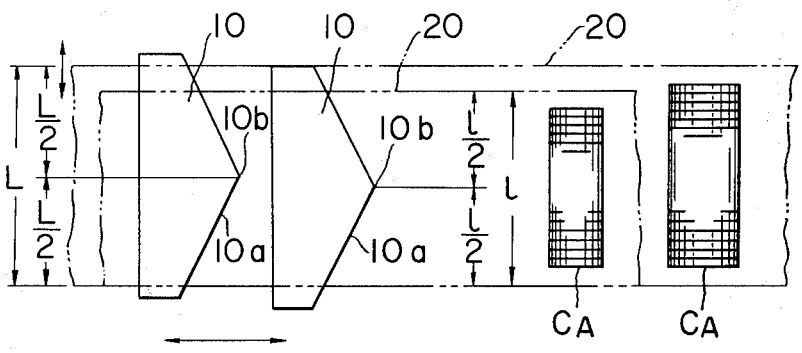
FIG. 3 is a schematic side elevation explanatory of the principles on which the position of the cutter blade is adjusted in the transverse direction of the wrapper strip extending therepast.

If, as shown in FIG. 3, there are prepared two wrapper strips 20 of different widths for selective use with the respective coin stacks CA of different heights, then the cutter blade 10 may be selectively moved to either of twc vertically spaced positions. Let L and l be the widths of the two wrapper strips prepared. The cutter blade 10 must then be so adjusted in its vertical position that the apex 10*b* of its cutting edge 10*a* will be in register with the central position L/2 or l/2 of either of the two wrapper strips with respect to its transverse direction.

The means for thus adjusting the position of the cutter blade 10 in the transverse direction of the wrapper strip will become apparent by referring back to FIG. 2. A lever 66 is fixedly mounted at one end on the rotatable shaft 60 and is therefore swingable correspondingly to the swinging motion of the L-shaped link 61 caused by the up-and-down motion of the wrapper width sensing member 23. The position of the cutter blade 10 is therefore adjustably varied as aforesaid in the transverse direction of the wrapper strip extending therepast. It may be noted that the distance the cutter blade 10 travels upon each swinging motion of the link 61 is one half the distance the upper arm 30 is caused to travel by the same swinging motion of the link.

It is also desirable to adjustably move the cutter blade 10 horizontally, that is, in the longitudinal direction of the wrapper strip extending therepast, in order that the wrapper strip may be cut to a length suiting the diameter of the coins to be wrapped. In this manner each severed piece of wrapper strip is wound around the coin stack the same number of turns regardless of the diameter of the coins.

Figure 4:
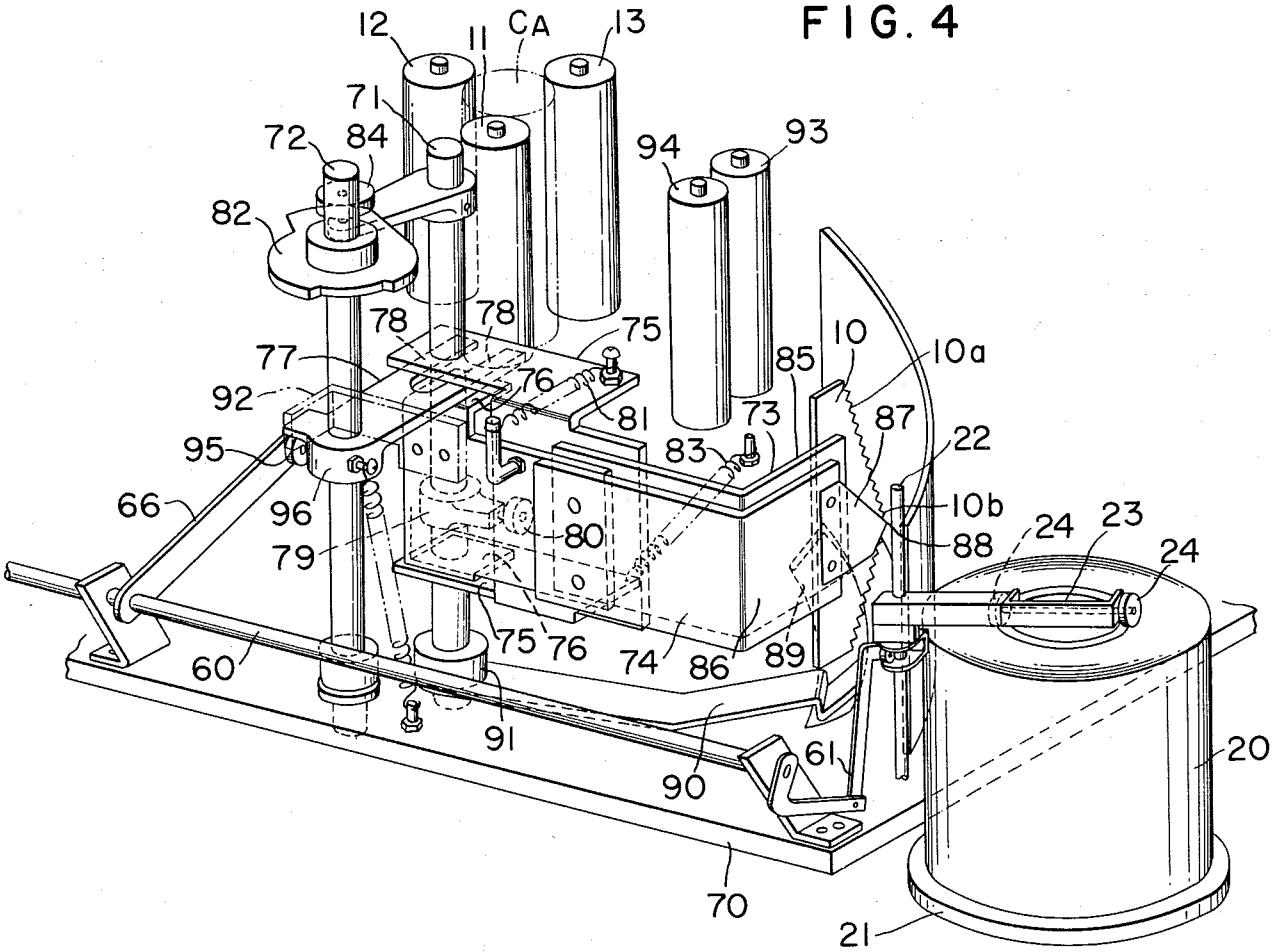
FIG. 4 is a relatively enlarged perspective view showing in greater detail the means for adjusting the position of the cutter blade in accordance with the width of the wrapper roll in the apparatus of FIG. 1.

FIG. 4 illustrates an example of the means for thus adjusting the position of the cutter blade 10. First and second columns 71 and 72 are rotatably mounted in suitable proximity to each other on a base plate 70 which is fixedly supported within the casing of the coin packaging apparatus 1. Slidably mounted on the first column 71 are a support structure 73 for the cutter blade 10 and another support structure 74 for a separator plate 87. It will be seen that the first column 71 extends through pairs of right-angularly bent portions 75 and 76 at the basal ends of the respective support structures 73 and 74. A floating member 77 slidably mounted on the second column 72 has its bifurcated end 78 fitted over the first column 71 by being received between the upper bent portions 75 and 76 of the support structures 73 and 74.

A roll 80 carried by a spacer 79 mounted on the first column 71 is interposed between the support structures 73 and 74. A helical tension spring 81 extends between the support structures 73 and 74. The roll 80 and spring 81 coact to hold the support structures 73 and 74 in parallel spaced relationship.

Another helical tension spring 83 extends between the base plate 70 and support structure 73 to bias the spacer 79 in the counterclockwise direction as seen in FIG. 4. A cam follower 84 bracketed to the first column 71 is therefore yieldably urged against the circumference of a cam 82 fixedly mounted on the second column 72. The circumference of this cam 82 is so contoured that the cutter blade 10 on the free end of the support structure 73 moves horizontally to a position selected in accordance with the diameter of the coins to be wrapped, so as to cut the wrapper strip 20 to a length suitable for wrapping up the coins of the particular diameter or denomination.

The support structure 73 has its free end portion 85 bent at right angles to carry the cutter blade 10 having the sawtooth-shaped cutting edge 10*a*. The other support structure 72 also has its free end portion 86 bent at right angles in the same direction as the portion 85 and carries the separator plate 87. This separator plate can be made of a sheet of suitable resilient material such as, most suitably, phosphor bronze. The separator plate 87 also has a V-shaped separating edge whose apex 88 projects slightly beyond the cutting edge 10*a* of the cutter blade 10.

An arcuate aperture 89 is formed in the base plate 70 in register with the path along which the cutter blade 10 swings. A guide arm 90 has its end 91 secured to the first column 71. The free end of this guide arm swings along the arcuate aperture 89 in step with the cutter blade 10. A pair of friction rolls, not shown, are assumed to be arranged adjacent the wrapper roll 20 on its mount 21, the unshown rolls being driven intermittently to deliver the wrapper strip to the cutter blade 10, as has been known heretofore.

It will be apparent that the two support structures 73 and 74 are simultaneously swingable about the first column 71 and, moreover, movable up and down relative to the same. The support structure 74 has a stop 92 extending toward the second column 72 such that, following the simultaneous swing of the two support structures 73 and 74 through a predetermined angle, only the support structure 73 for the cutter blade 10 will be allowed to swing, as then the stop 92 is held in abutting contact with the second column 72.

The numerals 11, 12 and 13 in FIG. 4 refer to the three wrapping rolls of the coin wrapping mechanism 14. The drawing also shows a pair of friction rolls 93 and 94 for directing the wrapper strip from its roll 20 past the cutter blade 10 under tension, as later described in more detail.

FIG. 4 also illustrates in greater detail the above described means for adjusting the position of the cutter blade 10 in the transverse direction of the wrapper strip extending therepast. A roll 95 carried on the free end of the aforesaid lever 66 is disposed under the end 96 of the floating member 77 which is slidably mounted on the second column 72. Thus, as the wrapper roll 20 having a width suiting the particular denomination of the coins to be packaged is mounted in position on the mount 21, the wrapper width sensing member 23 senses the width or height of the wrapper roll to cause the lever 66 to swing up or down through a corresponding angle. The position of the cutter blade 10 is therefore adjustably varied in the vertical direction so that the apex 10*b* of its cutting edge 10*a* will be located centrally of the wrapper strip with respect to its transverse direction.

The above described means for adjusting the cutter blade 10 to the central position in the transverse direction of the wrapper strip is subject to a variety of modifications within the usual knowledge of those skilled in the art. For example, the floating member 77 may be operatively associated with a dial that can be manually turned to several specified angular positions in accordance with the denomination of the coins to be handled by the apparatus. The manual turn of this dial causes, via suitable cam means, the floating member 77 to move up or down relative to the second column 72 so that the cutter blade 10 will be shifted to the central position of the wrapper strip.

The rotation of the aforesaid dial can also be utilized for selectively varying the length to which the wrapper strip is cut by the cutter blade 10 according to the denomination of the coins to be wrapped. To this end, bevel gearing is used to cause rotation of the cam 82 mounted on the second column 72 in response to the rotation of the dial.

Figure 5:
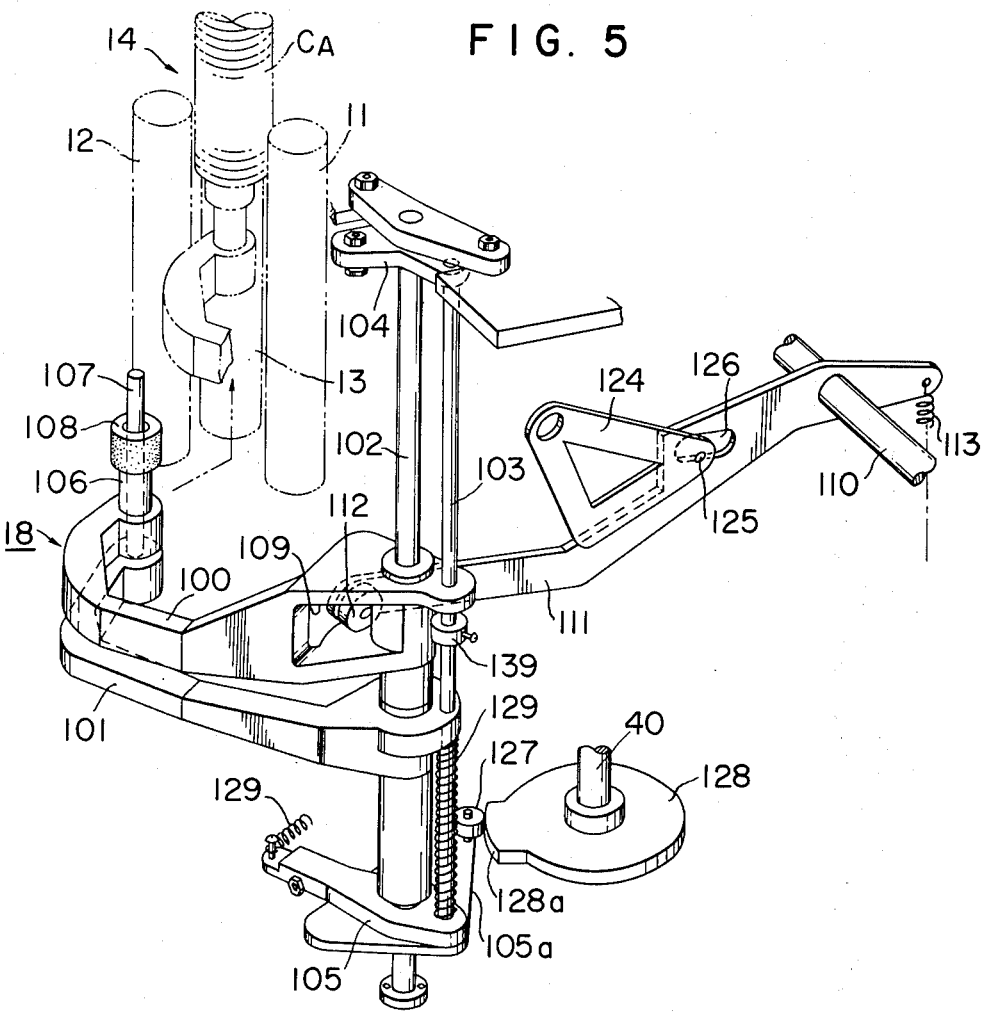
FIG. 5 is a similar view of a coin support mechanism in the apparatus of FIG. 1.

FIG. 5 illustrates in detail the coin support mechanism 18 previously mentioned with reference to FIG. 1. The coin support mechanism 18 includes a pair of substantially L-shaped arms 100 and 101 which are arranged in vertical register with each other and which are slidably mounted each at one end on a pair of shafts or rods 102 and 103 extending vertically in parallel spaced relationship. The rod 102 is assumed to be immovably supported at its top and bottom ends, whereas the other rod 103 extends between a pair of support members 104 and 105 pivotally mounted on the rod 102.

The upper arm 100 has a coin support member 106 of hollow, cylindrical shape fixedly mounted on its free end. The coin support member 106 includes a portion 108 intended to make direct contact with the stack of coins formed by the stacking cylinder 7, FIG. 1, so that at least this portion 108 of the coin support member is preferably made of rubber, plastics, or like suitably resilient material. Fixedly mounted on the free end of the lower arm 101 is a coin support pin 107 which slidably extends upwardly through the upper arm 100 and the coin support member 106. This pin projects a suitable distance from the top end of the coin support member 106 when the arms 100 and 101 are held close to, or in contact with, each other.

The coin support member 106 is designed to support thereon the stack of coins to carry the same from the stacking cylinder 7 down to the coin wrapping mechanism 14. The pin 107 then becomes operative to hold the stack of coins thereon during the subsequent coin wrapping and crimping operations, thereby preventing the interference of the coin support mechanism 18 with the operations of the wrapping rolls 11 to 13 and cimping hooks 15.

Figure 6:
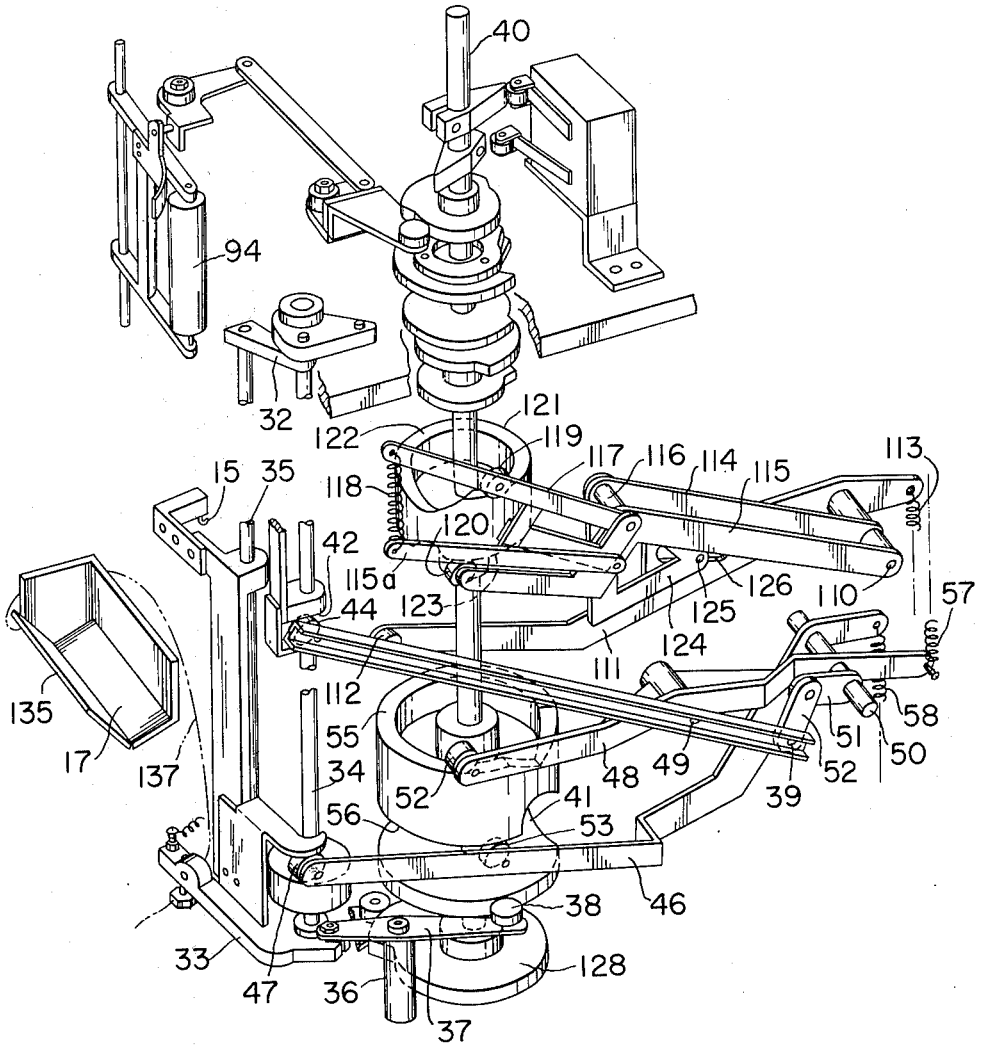
FIG. 6 is also a similar view showing means for actuating the coin support mechanism of FIG. 5, together with the means for adjusting the spacing between the crimping hooks shown in FIG. 2.

The upper arm 100 has a recess 109 for receiving a roll 112 on one end of an arm 111 which is pivotally mounted at the other end on a horizontal shaft 110. A helical tension spring is provided at 113 to bias the upper arm 100 upwardly. As seen in FIG. 6, a pair of arms 114 and 115 are mounted each at one end on the shaft 110, and a lever 117 is fixedly mounted on a horizontal shaft 116 pivotally supported at the other end of the arm 114. A helical tension spring 118 extends between the lever 117 and the free end 115*a* of the arm 115 to bias the same toward each other. The lever 117 and arm 115 carry cam followers 119 and 120, respectively, which are yieldably urged into contact with the top and bottom circumferential edges 122 and 123 of a cam 121 on the camshaft 40.

A triangular link 124 is secured to the horizontal shaft 116 at one of its apexes, and a pin 125 is imbeddedly fixed at its root portion to the link 124 at another apex thereof. This pin is slidably fitted in a slot 126 formed in the arm 111, so that the swinging motion of the lever 117 results in a corresponding swinging motion of the arm 111.

With reference again to FIG. 5, a cam follower 127 is mounted on a member 15*a* integral with the support member 105 supporting the rod 103. This cam follower is urged by a helical tension spring 129 into contact with the circumference of a cam 128 on the camshaft 40. When the cam follower 127 rides over the protuberance 128*a* of the cam 128, the arms 100 and 101 swing about the rod 102 to their retracted position remote from the coin wrapping mechanism.

A compression spring 129 is coiled around the rod 103 so as to extend between the lower arm 101 and the lower support member 105. Thus, upon upward motion of the upper arm 100, the lower arm 101 is elevated simultaneously until the lower arm moves into contact with a stop 139 mounted on the rod 103. In this elevated position of the lower arm 101, the coin support pin 107 holds the stack of coins thereon in the predetermined position where a wrapper strip is wound around the coin stack while the same is being rotated by the three wrapping rolls 11 to 13.

The construction and operation of the wrapping rolls 11 to 13 are conventional. Also conventional are the functions of wrapper guides 131, 132 and 133, FIG. 1, that guides the wrapper strip around the stack of coins supported centrally between the wrapping rolls. These known parts of the apparatus are therefore not described herein in any detail.

Arranged under the coin wrapping mechanism 14 is a chute 134 leading to the dispensing opening 17 formed in the front panel of the coin packaging apparatus 1, as illustrated in FIG. 1. The dispensing opening 17 has a stop plate 135 hingedly supported at 136. The stop plate 135 is designed principally to prevent the packaged stack of coins from falling out of the opening 17 and secondarily to prevent the scattering of loose coins, if any. A flexible wire 137 extends between this stop plate 135 and the lower support plate 33 of the wrapper crimping mechanism 16. The stop plate 135 is pivoted upwardly to the position shown in FIG. 1 by the flexible wire 137 when the arms 30 and 31 of the crimping mechanism 16 swing to their retracted position away from the wrapping mechanism 14.

In operation, the wrapper roll 20 which has been selected in accordance with the denomination of the coins to be packaged and which, therefore, has a width suitably in excess of the height of the stack of the predetermined number of the coins is first placed centrally on the mount 21. While the wrapper roll is being thus placed on the mount 21, the wrapper width sensing member 23 of the sensing mechanism A must be swung away from over the mount 21 so as to press the actuator 29*a* of the switch 29, as will be best understood from FIG. 2. Since, then, the pin 25 is received in the horizontal limb 28 of the inverted-L-shaped slot 27, thereby holding the wrapper width sensing member 23 in its retracted position against any possibility of downward motion, the operator is free to use both hands for installation of the wrapper roll 20 on the mount 21.

Upon installation of the wrapper roll the sensing member 23 is swung back to the position shown in FIG. 2, in which the sensing member extends in the diametrical direction of the wrapping roll. The pin 25 is now received in the vertical limb of the slot 27, so that the sensing member 23 descends by gravity until the pair of rolls 24 carried thereby contact the hollow core 20*a* of the wrapper roll 20 at its diametrically opposite points.

The descent of the wrapper width sensing member 23 results in the counterclockwise swing, as viewed in FIG. 2, of the link 61 about the shaft 60, thereby causing the latter to rotate in the same direction. The counterclockwise rotation of the shaft 60 results, in turn, in the clockwise rotation of the shaft 50 via the lever 63, link 64 and lever 65. The lever 51 fixedly mounted on the shaft 50 thereupon causes the lever 43 to swing counterclockwise about the pivot pin 49 via the link 52. Since the free end of this lever 43 is coupled via the roll 44 to the upper arm 30 carrying the crimping hook 15, the upper arm then slides downwardly along the rods 34 and 35. The position of the upper arm 30 with its crimping hook 15 is thus adjusted to the width or height of the wrapper roll 20 that has been installed on the mount 21.

The counterclockwise rotation of the shaft 60 results also in the swinging motion of the lever 66 fixedly mounted thereon. The lever 66 causes the floating member 77 to slide downwardly along the second column 72 via the roll 95, as seen in FIG. 4, so that the cutter blade 10, as well as the separator plate 87, descend to a position in which the apex 10*b* of its V-shaped cutting edge 10*a* is located centrally in the transverse direction of the wrapper strip which extends therepast from its roll 20.

The coin packaging apparatus 1 can now be set in operation. A batch of coins which has been charged into the hopper 2, FIG. 1, is directed onto the rotary disc 3 and thence successively onto the passageway extending radially outwardly therefrom. The coins are counted by the counter mechanism 138 as they are transported over the passageway by the overhead belt conveyor 5. The counter mechanism 138 closes the passageway when it counts a predetermined number of the coins traveling therepast. The coins are directed into the stacking cylinder 7, in which they are rearranged into a neat stack in the conventional manner on the plate members 8 of the shutter mechanism 9 now closing the bottom of the cylinder.

At this juncture the camshaft 40 best illustrated in FIG. 6 is set in rotation by conventional means. The cam followers 119 and 120 on the free ends of the lever 117 and arm 115 are then received in the depressions on the top and bottom circumferential edges 122 and 123 of the cam 121 on the camshaft 40, thereby causing the lever 117 and arm 115 to swing toward each other by the force of the tension spring 118. The upward swing of the arm 115 results in the upward swing of the arm 111, and the downward swing of the lever 117 results in the upward motion of the pin 125 on the link 124 which is fixedly mounted on the shaft 116, so that the arm 111 is caused to swing further upwardly as the pin 125 is received in the slot 126 in the arm 111.

With reference to FIG. 5, the arm 111 thus causes, via the roll 112 on its free end, the upper arm 100 of the coin support mechanism 18 to move to its most elevated position by sliding along the rods 102 and 103.

The coin support member 106 on the upper arm 100 is now positioned immediately under the shutter plate members 8 closing the bottom end of the stacking cylinder 7. It will be apparent that the compression spring 129 causes the lower arm 101 to follow the upper arm 100 as the latter moves upwardly. The ascent of the lower arm 101 is arrested as the same moves into contact with the stop 139 on the rod 103, and the coin support pin 107 on the lower arm is now buried in the support member 106.

It is assumed that at this instant, the wrapping rolls 11 to 13 of the coin wrapping mechanism are already moved to their predetermined standby positions from the retracted positions and are thus made ready for accepting the stack of coins in the central position therebetween. The shutter plate members 8 are now opened by the action of an unshown cam on the camshaft 40, in accordance with the prior art, with the result that the stack of coins within the stacking cylinder 7 is deposited on the portion 108 of the coin support member 106.

With reference again to FIG. 6, the cam follower 119 on the lever 117 will then relatively move out of the depression on the top circumferential edge 122 of the cam 121 on the camshaft 40, so that the arm 111 is caused to gradually swing downwardly via the link 124. As the upper arm 100 of the coin support mechanism 18 resultantly descends along the rods 102 and 103, the pin 107 on the lower arm 101 projects upwardly through the axial hollow in the coin support member 106. Just at the instant the pin 107 projects out of the coin support member 106, that is, when the stack of coins is transferred from the member 106 onto the pin 107, the cam follower 120 on the arm 115 shifts from the depression on the bottom circumferential edge of the cam 121 to a slightly less depressed portion on the cam edge. Thereupon, by the interaction of the arm 115 and lever 117, the upper arm 100 starts descending at a significantly reduced speed, so that the stack of coins can be transferred from the support member 106 onto the pin 107 substantially without possibility of collapsing.

With the stack of coins thus shifted onto the pin 107 on the lower arm 101, the upper arm 100 continues to descend until the top of its coin support member 106 becomes lower than the bottom ends of the wrapping rolls 11 to 13. The coin support member 106 is thus moved out of the way of the lower crimping hook 15 and of the wrapper strip.

The wrapping rolls 11 to 13 are succeedingly moved into circumferential contact with the stack of coins on the coin support pin 107, and the friction rolls 93 and 94 are also moved into circumferential contact with each other and are set in rotation to unwind the wrapper strip from its roll 20 past the cutter blade 10, as best shown in FIG. 4. Owing to the tension thus exerted on the wrapper strip, the same is cut to a pre-adjusted length by the cutter blade 10. The severed piece of wrapper strip is fed between the stack of coins and the wrapping rolls along a predetermined path of travel and is wound around the stack of coins as the same rotates in frictional contact with the rolls.

Upon completion of the winding of the piece of wrapper strip around the stack of coins, the cam 41 on the camshaft 40 causes the support plate 33 of the wrapper crimping mechanism 16 to swing clockwise, as seen in FIG. 2, about the rod 34. The pair of crimping hooks 15 carried on the free ends of the arms 30 and 31 are then simultaneously moved close to the marginal edges of the wrapper strip projecting beyond the top and bottom ends of the stack of coins. The cam followers 52 and 53 on the levers 48 and 46 then become received in the depressions on the top and bottom circumferential edges 55 and 56 of the cam 54 on the camshaft 40, as the levers 46 and 48 are biased toward each other by the tension springs 57 and 58. The resulting swinging motion of the lever 48 is transmitted via the pin 49 to the lever 43 for the up-and-down motion of the upper arm 30, so that the upper arm descends a predetermined distance by sliding along the rods 34 and 35.

As the upper and lower arms 30 and 31 are thus moved toward each other, the pair of crimping hooks 15 will engage the respective marginal edges of the wrapper strip wound around the stack of coins. The crimping hooks 15 operate in accordance with the prior art to fold the marginal edges of the wrapper strip over the top and bottom ends of the stack of coins.

With the stack of coins thus wrapped up completely, the cam followers 52 and 53 move relatively out of the depressions on the top and bottom circumferential edges 55 and 56 of the cam 54, so that the levers 46 and 48 are swung away from each other to cause the arms 30 and 31, and therefore the crimping hooks 15, to move away from each other. The cam follower 38 also relatively moves away from the depression 41*a* on the circumference of the cam 41 to cause the support plates 32 and 33 to swing counterclockwise, as seen in FIG. 2, about the rod 34. The arms 30 and 31 simultaneously swing counterclockwise and thus retract away from the coin wrapping mechanism 14.

At the same time the cam 121 on the camshaft 40 causes the arm 111 to swing further downwardly, so that the upper arm 100 of the coin support mechanism descends to its predetermined lowermost position with the lower arm 101. As the cam follower 127 succeedingly rides over the protuberance 128*a* of the cam 128, the support members 104 and 105 jointly swing about the rod 102 against the force of the tension spring 129 in such a direction that the coin support mechanism also retracts away from the coin wrapping mechanism 14, thereby dropping the packaged stack of coins into the chute 134. This package of coins is then delivered to the dispensing opening 17 by sliding through the chute 134. The package of coins will not fall out of the dispensing opening as the stop plate 135 pivots upwardly to the position of FIG. 1 with the counterclockwise swinging motion of the support plate 33.

For packaging coins of a different denomination by the coin packaging apparatus 1, the wrapper roll 20 may have to be replaced by one having a width suitable for use with the coins of the different denomination. The wrapper roll is easily replaceable by manually raising the wrapper width sensing member 23 and turning the same aside so that the pin 25 enters the horizontal limb 28 of the slot 27. The wrapper roll 20 that has been in use can now be removed, and a new roll installed in position on the mount 21. In the meantime the wrapper width sensing member 23 is held pressed against the actuator 29*a* of the switch 29, so that the operation of the apparatus cannot be initiated if the starting switch or the like, not shown, of the apparatus is inadvertently actuated.

The wrapper width sensing member 23 is next swung back and allowed to fall into the new wrapper roll on the mount 21. The member 23 thus senses the width of the new wrapper roll, and the positions of the upper arm 30 of the crimping mechanism 16 and the cutter blade 10 are re-adjusted correspondingly in the manner previously set forth.

The various objects of this invention, either expressly stated or otherwise, are believed to have been fully realized in the preferred form of the coin packaging apparatus shown and described hereinbefore. It is also understood, however, that the invention itself is not to be restricted by the exact showing of the drawings or the description thereof, as many modifications will readily occur to the specialists on the basis of this disclosure.

What is claimed is:

1. In a coin packaging apparatus of the type which comprises stacking means for arranging each preselected number of coins of the same denomination into a neat stack, cutter means for severing a wrapper strip as the same is unwound from its roll, coin wrapping means for winding the severed piece of wrapper strip around the circumference of the stack of coins, and a pair of crimping hooks for crimping the opposite lateral marginal edges of the piece of wrapper strip over both ends of the stack of coins, the combination thereof with:

means for rotatably holding the roll of wrapper strip having a width selected in accordance with the height of the stack of coins to be wrapped, in such a manner that one of the opposite marginal edges of the wrapper roll will always lie in a predetermined position thereon regardless of its width;

wrapper width sensing means including a wrapper width sensing member which is movable in the transverse direction of the wrapper roll on said holding means into and out of contact with the other marginal edge thereof; and hook adjusting means responsive to the motion of said wrapper width sensing member into contact with said other marginal edge of the wrapper roll on said holding means for adjustably moving one of said crimping hooks in the direction of the other crimping hook in accordance with the width of the wrapper roll.

2. The combination of claim 1, wherein said crimping hooks are carried by respective arms which are movable toward and away from each other, and wherein said hook adjusting means comprises:

cam means for causing said arms to move toward and away from each other whereby said crimping hooks are moved into and out of engagement with the marginal edges of the piece of wrapper strip which has been wound around the stack of coins;

a first lever pivotally supported at one end and carrying a cam follower on another end, said cam follower being associated with said cam means whereby said lever is pivotable on said one end as dictated by said cam means;

a pivot pin projecting laterally from said first lever at a point intermediate both ends thereof;

a second lever pivotally supported at its intermediate point on said pivot pin, said second lever having one end operatively coupled to one of said arms carrying said one crimping hook to cause the same to move toward and away from the other crimping hook; and linkage means operatively connecting said wrapper width sensing member to the other end of said second lever whereby, upon movement of said wrapper width sensing member into contact with said other marginal edge of the wrapper roll on said holding means, said second lever is caused to swing about said pivot pin through an angle determined by the width of the wrapper roll.

3. The combination of claim 1, wherein said cutter means includes a cutter blade having a V-shaped cutting edge for cutting the wrapper strip as the same extends under tension therepast from its roll toward said coin wrapping means, and wherein the combination further includes cutter adjusting means responsive to the motion of said wrapper width sensing member into contact with said other marginal edge of the wrapper roll on said holding means for adjustably moving said cutter blade in the transverse direction of the wrapper strip which extends therepast in order that the apex of said V-shaped cutting edge will be located centrally of the wrapper strip with respect to its transverse direction.

4. The combination of claim 3, wherein said cutter adjusting means comprises:

a column disposed in the transverse direction of the wrapper strip extending past said cutter blade;

support structure slidably mounted on said column and carrying said cutter blade thereon; and means for causing said support structure to slide along said column in response to the motion of said wrapper width sensing member into contact with said marginal edge of the wrapper roll.

5. The combination of claim 1, further comprising signal generating means including an electric switch which is adapted to be actuated by said wrapper width sensing member while the same is out of contact with said other marginal edge of the wrapper roll on said holding means, and which thereupon causes the signal generating means to generate and transmit a control signal for preventing operation of the coin packaging apparatus until the actuation of the switch stops.

6. The combination of claim 5, wherein said wrapper width sensing means includes means for retaining said wrapper width sensing member in a retracted position, where the same is out of contact with said other marginal edge of the wrapper roll, during replacement of the wrapper roll on said holding means.

7. The combination of claim 6, wherein said switch is held actuated by said wrapper width sensing member while the latter is retained in said retracted position.

8. The combination of claim 1, wherein the wrapper roll includes a core, and wherein said wrapper width sensing member has a pair of rollers mounted thereon, said rollers being movable into and out of contact with said core of the wrapper roll on said holding means at its diametrically opposite points.

* * * * *